US009614309B1

(12) United States Patent
Miklinski, Jr. et al.

(10) Patent No.: US 9,614,309 B1
(45) Date of Patent: Apr. 4, 2017

(54) ELECTRICAL CONNECTOR ASSEMBLY

(71) Applicant: HIROSE ELECTRIC CO., LTD., Tokyo (JP)

(72) Inventors: Richard Miklinski, Jr., Aurora, IL (US); Jeremy Yasuhiro Huang, Lombard, IL (US); William John MacKillop, Wheaton, IL (US)

(73) Assignee: Hirose Electric Co., Ltd., Tokyo (JP)

( * ) Notice: Subject to any disclaimer, the term of this patent is extended or adjusted under 35 U.S.C. 154(b) by 0 days.

(21) Appl. No.: 15/204,251

(22) Filed: Jul. 7, 2016

(51) Int. Cl.

| | |
|---|---|
| ***H01R 12/00*** | (2006.01) |
| ***H01R 12/71*** | (2011.01) |
| ***H01R 13/506*** | (2006.01) |
| ***H01R 13/04*** | (2006.01) |
| ***H01R 13/424*** | (2006.01) |

(52) U.S. Cl.
CPC ..... *H01R 12/716* (2013.01); *H01R 13/04* (2013.01); *H01R 13/424* (2013.01); *H01R 13/506* (2013.01)

(58) Field of Classification Search
CPC H01R 23/725; H01R 23/722; H01R 23/7026; H01R 13/506
USPC ..... 439/74, 71, 70, 330, 331, 525
See application file for complete search history.

(56) References Cited

U.S. PATENT DOCUMENTS

| | | | | |
|---|---|---|---|---|
| 4,495,380 | A * | 1/1985 | Ryan | F16B 21/082 174/138 D |
| 4,697,859 | A * | 10/1987 | Fisher, Jr. | H01R 13/6315 439/246 |
| 7,210,941 | B2 * | 5/2007 | Rosenberger | H01R 13/2464 439/63 |
| 8,360,789 | B2 * | 1/2013 | Yin | H01R 12/52 439/66 |
| 8,734,167 | B2 | 5/2014 | Aimoto | |
| 2004/0038586 | A1 * | 2/2004 | Hall | H01R 13/6315 439/578 |

* cited by examiner

*Primary Examiner* — Phuongchi T Nguyen
(74) *Attorney, Agent, or Firm* — Procopio, Cory, Hargreaves & Savitch LLP

(57) ABSTRACT

An electric connector assembly includes an intermediate connector for connecting the first mating connector to the second mating connector to facilitate connections between two circuit boards, which includes a power supply terminal having a main body portion and a flange portion having a larger width than the main body portion; an outer housing including a first inner housing portion affixed to the outer housing, the first inner housing portion having a first terminal penetrating portion configured to engage with the main body portion of a power supply terminal and latching portions. The intermediate connector also includes a second inner housing portion configured to align with the first inner housing portion that has engaging portions configured to engage the second inner housing portion to the outer housing via the latching portions; and a second terminal penetrating portion, configured to engage with the main body portion of the power supply terminal.

8 Claims, 5 Drawing Sheets

ELECTRICAL CONNECTOR ASSEMBLY

BACKGROUND

Field

The present invention relates to an electrical connector assembly. More specifically, the present invention relates to an electrical connector assembly including a power supply terminal.

Related Art

In a related art electrical connector assembly, as described in U.S. Pat. No. 8,734,167, herein incorporated by reference in its entirety, there is a connector assembly as illustrated in FIG. 1. In the related art example of FIG. 1, the electrical connector assembly includes an intermediate connector 10 having a housing 11 and two power supply terminals 21. The housing 11 is made of an electrical insulating material and has a substantial rectangular tubular shape with a space penetrating in a vertical direction. The power supply terminal 21 is supported by the housing 11 and extending in the vertical direction within the space of the housing 11 penetrating vertically. The power supply terminal 21 is made from a metal and has a shape of a straight pin. In the related art example of FIG. 1, the power supply terminal 21 is made as a rigid body and includes a main body portion 22 and a flange portion 23. The main body portion 22 has a shape of a pin with a circular sectional shape. The flange portion 23 is provided in a lower portion of the power supply terminal 21. The flange portion 23 has a shape of a ring projecting outward in a direction of a radius of the main body portion 22. An upper end and a lower end of the main body portion 22 are formed to be rounded. Further, the flange portion 23 includes a circumferential surface 23A having a conic shape expanding in a lower direction.

The housing 11 for supporting the power supply terminal 21 having the rectangular tubular shape has a rectangular sectional shape which is elongated in a direction the power supply terminals 21 are arranged. The housing 11 includes receptacle portions 12 and 13 in an upper and lower edge portions thereof, respectively. The terminal penetrating portion 14 has a hole formed between thin walls 16 as being viewed in the direction perpendicular to a direction the power supply terminals 21 are arranged. A space is formed between an inner surface of the thin wall 16 and the power supply terminal 21. In addition, the thin wall 16 forms a space 16A between a rear side thereof and a sidewall 17.

As shown in the related art example of FIG. 1, there is a terminal penetrating portion 14 which includes an elastic arm portion 18 in the lower portion thereof. The elastic arm portion 18 extends from a middle portion of the sidewall 17 of the housing 11, at a position situated on an upper side relative to the flange portion 23. The elastic arm portion 18 extends in the lower direction. The elastic arm portion 18 engages a lower surface of the flange portion 23 with a hook portion 18A provided in a lower end thereof. Additionally, a locking arm 19A extending in the lower direction and capable of elastic displacement is provided in a lower portion.

Accordingly, the upper surface of the flange portion 23 is held by the bottom portion of a concaved portion and an edge portion of the thin wall 16 in one of the direction of the radius, as well as the lower surface of the flange portion 23 is held by the hook portion 18A of the elastic arm portion 18 in a direction perpendicular to the direction supra. Thereby, the power supply terminal 21 is positioned vertically.

However, in some designs requiring shorter electrical connector assemblies (e.g. millimeters of reduction), a problem can occur that when the related art electrical connector assembly is made shorter, the elastic arm portion 18 may not be implementable within the related art electrical connector assembly due to lack of available spacing. Further, in some cases where the elastic arm portion 18 is implementable within a shorter version of the electrical connector assembly of FIG. 1, reduction of flexibility of the intermediate connector 10 may occur due to lack of available space. In some implementations of the electrical connector assembly, the intermediate connector 10 may have a minimum length restricted by the length of the elastic arm portion 18, which may be larger than the desired implementation.

SUMMARY

In view of the problems described above, an object of the present invention is to provide an electrical connector assembly which solves the problems of the conventional electrical connector assembly. In the electrical connector assembly of the present invention, the intermediate connector is configured with an inner housing that is provided to engage the terminal and to be engaged with the outer housing of the intermediate connector. Further, the outer housing may contain engaging portions such as an elastic arm to engage with the inner housing instead of the terminal. Accordingly, the intermediate connector can therefore be made shorter while retaining sufficient space to provide flexibility within the electrical connector assembly.

According to an aspect of the present invention, there is an electric connector assembly, which involves a first mating connector to be attached to a first circuit board; a second mating connector to be attached to a second circuit board; and an intermediate connector disposed between the first mating connector and the second mating connector for connecting the first mating connector to the second mating connector.

According to an aspect of the present invention, the intermediate connector can involve a plurality of power supply terminals, each of the plurality of power supply terminals comprising a main body portion and a flange portion having a larger width than the main body portion; an outer housing having a first inner housing portion affixed to the outer housing, the first inner housing portion comprising a plurality of first terminal penetrating portions, each of the plurality of terminal penetrating portions configured to engage with the main body portion of a power supply terminal from the plurality of power supply terminals; and latching portions, and a second inner housing portion configured to align with the first inner housing portion, the second inner housing portion involving engaging portions configured to engage the second inner housing portion to the outer housing via the latching portions; and a plurality of second terminal penetrating portions, each of the plurality of second terminal penetrating portions configured to engage with the main body portion of the power supply terminal from the plurality of power supply terminals.

According to an aspect of the present invention, the flange portion of the power supply terminal from the plurality of power supply terminals is disposed between the first inner housing and the second housing and is arranged to contact with an edge of at least one of the plurality of first terminal penetrating portions and the plurality of second terminal penetrating portions, wherein the flange portion has a width greater than a first width of the plurality of first terminal penetrating portions and greater than a second width of the plurality of second terminal penetrating portions.

According to an aspect of the present invention, the main body portion of the plurality of power supply terminals are cylindrical, wherein the main body portion is accommodated with a space within the plurality of first terminal penetrating portions and the plurality of second terminal penetrating portions so that the main body portion can move within the plurality of first terminal penetrating portions and the plurality of second terminal penetrating portions, wherein the flange portion is arranged to contact with the edge of at least one of the plurality of first terminal penetrating portions and the plurality of second terminal penetrating portions.

According to an aspect of the present invention, the latching portions are elastic arms disposed on opposite sides of the outer housing and configured to be in contact with the second inner housing without coming in contact with the plurality of power supply terminals.

According to an aspect of the present invention, the flange portion of the plurality of the power supply terminals are disposed such that the main body portion is divided into a first body portion and a second body portion, the first body portion being longer than the second body portion; wherein the first body portion is configured to be engaged with the plurality of first terminal penetrating portions, and wherein the second body portion is configured to be engaged with the plurality of second terminal penetrating portions.

According to an aspect of the present invention, there is an electric connector assembly, which involves a first mating connector to be attached to a first circuit board; a second mating connector to be attached to a second circuit board; and an intermediate connector disposed between the first mating connector and the second mating connector for connecting the first mating connector to the second mating connector. The intermediate connector can include a power supply terminal having a main body portion and a flange portion having a larger width than the main body portion; an outer housing involving a first inner housing portion affixed to the outer housing, the first inner housing portion comprising a first terminal penetrating portion configured to engage with the main body portion of the power supply terminal; and latching portions; and a second inner housing portion configured to align with the first inner housing portion, the second inner housing portion involving engaging portions configured to engage the second inner housing portion to the outer housing via the latching portions; and a second terminal penetrating portion configured to engage with the main body portion of the power supply terminal; wherein the flange portion of the power supply terminal is disposed between the first inner housing and the second housing and is arranged to contact with an edge of at least one of the plurality of first terminal penetrating portions and the plurality of second terminal penetrating portions, wherein the flange portion has a width greater than a first width of the plurality of first terminal penetrating portions and greater than a second width of the plurality of second terminal penetrating portions.

According to an aspect of the present invention, there is an electric connector assembly, which involves a first mating connector to be attached to a first circuit board; a second mating connector to be attached to a second circuit board; and an intermediate connector disposed between the first mating connector and the second mating connector for connecting the first mating connector to the second mating connector. The intermediate connector can include a terminal having a main body portion and a flange portion having a larger width than the main body portion; an outer housing involving a first inner housing portion affixed to the outer housing, the first inner housing portion having first means for engaging with the main body portion of the power supply terminal; and latching means; and a second inner housing portion configured to align with the first inner housing portion, the second inner housing portion involving engaging means for engaging the second inner housing portion to the outer housing via the latching means; and second means for engaging with the main body portion of the power supply terminal; wherein the flange portion of the power supply terminal is disposed between the first inner housing and the second housing and is arranged to contact with an edge of at least one of the first means and second means, wherein the flange portion has a width greater than a first width of the first means and greater than a second width of the second means.

As described above, according to the present invention, the receptacle terminals of the mating connectors to be connected respectively to the both end portions of the power supply terminal are provided so as to be independent of each other. Further, either the receptacle terminal or the end portion of the power supply terminal includes the elastic tubular member. Accordingly, it is possible to obtain the floating by the same amount at any angle in the circumferential direction. As a result, it is possible to contact at any angle between the mating connector and the intermediate connector, as well as enabling the floating sufficiently and obtaining the contact pressure sufficiently.

DETAILED DESCRIPTION

Figure 1:
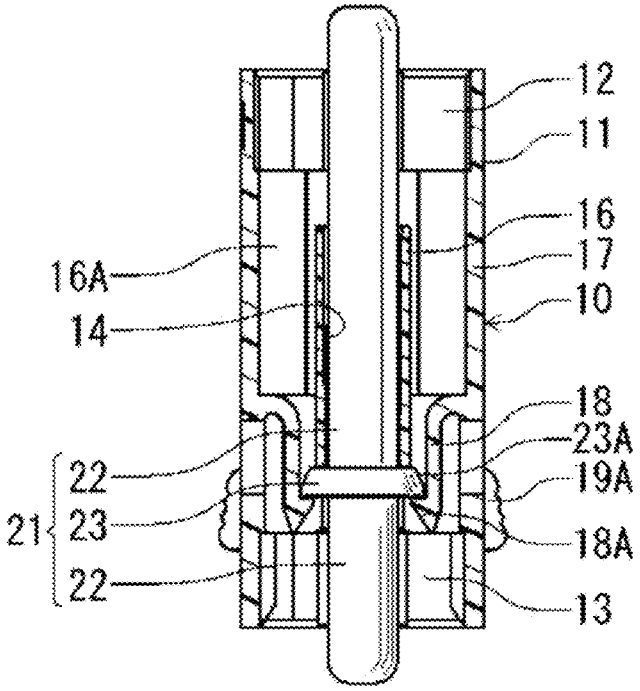
FIG. 1 (Related Art)
FIG. 1 illustrates a longitudinal sectional view of a related art electrical connector assembly taken along a direction perpendicular to a direction in which power supply terminals are arranged.

Hereunder, embodiments of the present invention will be explained with reference to the accompanying drawings. Reference numerals and descriptions of redundant elements between figures are omitted for clarity. Terms used throughout the description are provided as examples and are not intended to be limiting. Features and aspects from each of the embodiments may be used either singularly or in any combination with other aspects and features to achieve the desired implementation, and the present disclosure is not specifically limited to the configurations as described in each of the embodiments.

Figure 2:
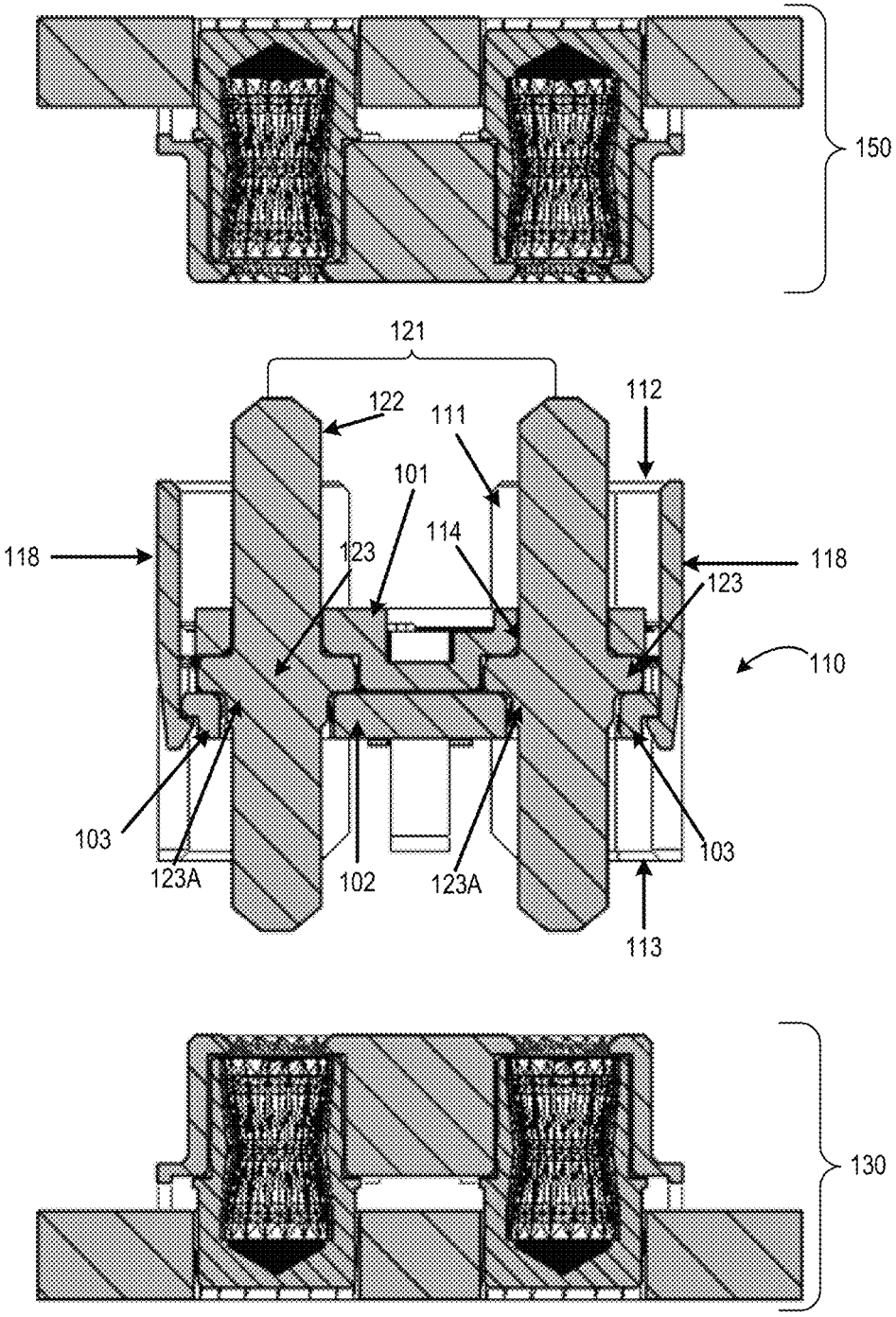
FIG. 2 is a longitudinal sectional view showing the electrical connector assembly taken along a direction perpendicular to a direction in which power supply terminals are arranged, according to an embodiment of the present invention.

FIG. 2 is a longitudinal sectional view showing the electrical connector assembly taken along a direction perpendicular to a direction in which power supply terminals are arranged, according to an embodiment of the present invention. FIG. 2 illustrates the electrical connector assembly in a state of before the intermediate connector 110 thereof is connected to mating connectors, that is, the first mating connector 130 and the second mating connector 150 thereof. First mating connector 130 is configured to be attached to a first circuit board, and second mating connector 150 is configured to be attached to a second circuit board.

As shown in FIG. 2, the intermediate connector 110 includes a housing 111 and two power supply terminals 121. The outer housing 111 is made of an electrical insulating material and has a substantial rectangular tubular shape with a space penetrating in a vertical direction. The power supply terminal 121 is supported by the outer housing 111 and extending in the vertical direction within the space of the housing 111 penetrating vertically. The power supply terminal 121 is made from a metal and has a shape of a straight pin. In the embodiment, the intermediate connector 110 includes two power supply terminals, but number of the power supply terminals is not limited two. The number of the power supply terminals may be one or three and more. Further, the power supply terminals may be arranged in a single row or in multiple rows.

In an embodiment of the present invention, the power supply terminal 121 is made as a rigid body and includes a main body portion 122 and a flange portion 123. The main body portion 122 has a shape of a pin with a circular sectional shape. The flange portion 123 is provided in a lower portion of the power supply terminal 121. The flange portion 123 has a shape of a ring projecting outward in a direction of a radius of the main body portion 122. An upper end and a lower end of the main body portion 122 are formed to be rounded, so that the first mating connector 130 and the second mating connector 150 as the mating connectors are able to be connected thereto ideally, as described later. Further, the flange portion 123 includes a circumferential surface 123A having a conic shape expanding in a lower direction.

In an embodiment of the present invention, the power supply terminal 121 is longer than a size of the housing in the vertical direction. Therefore, upon being supported by the outer housing 111, the power supply terminal 121 protrudes from an upper end and a lower end of the outer housing 111. In the embodiment, the power supply terminal 121 protrudes from the upper end and the lower end of the outer housing 111. The power supply terminal 121 may be depressed from the outer housing 111. In this case, terminals of the mating connectors, that is, terminals of the first mating connector 130 and the second mating connector 150 enter the outer housing 111.

In an embodiment of the present invention, the outer housing 111 for supporting the power supply terminal 121 having the rectangular tubular shape has a rectangular sectional shape which is elongated in a direction the power supply terminals 121 are arranged. The outer housing 111 includes receptacle portions 112 and 113 in an upper and lower edge portions thereof, respectively. The receptacle portions 112 and 113 receive the first mating connector 130 and the second mating connector 150 having rectangular tubular shapes as described later, respectively. A terminal penetrating portion 114 is formed between the receptacle portions 112 and 113 in the vertical direction.

Outer housing 111 may include a first inner housing portion 101 affixed to the outer housing 111. The first inner housing portion 101 manages first terminal penetrating portions 114 that are configured to engage the main body portion 122 of the power supply terminal 121. Outer housing 111 may also include a second inner housing portion 102 that can be affixed to the outer housing 111 that is configured to align with the first inner housing portion 101 and configured to engage the main body portion 122 of the power supply terminal 121. In an embodiment of FIG. 2, the power supply terminal 121 is inserted into the first terminal penetrating portion 114 such that the flange portion 123 comes in contact with the first inner housing portion 101. The flange portion 123 is set in place by being disposed between the first inner housing portion 101 and the second inner housing portion 102, as the width of the flange portion 123 is larger than the width of the first terminal penetrating portion 114.

As shown in FIG. 2, the outer housing 111 further includes latching portions 118 configured to engage with engaging portions 103 of the second inner housing portion. In the example of FIG. 2, the latching portions 118 are in the form of an elastic arm portion, and will be referred to as an elastic arm throughout the disclosure, other equivalent engaging portions may also be used depending on the desired implementation, and the present disclosure is not limited thereto. The elastic arm portion 118 extends from the side of the outer housing 111, at a position situated on an upper side relative to the flange portion 123. The elastic arm portion 118 extends in the lower direction. The elastic arm portion 118 engages a lower surface of an engaging portion 103 that is part of the second inner housing portion 102.

Accordingly, the upper surface of the flange portion 123 is held in place by the concaved portion of the first terminal penetrating portion 114 and an edge portion of the first inner housing portion 101 in one of the direction of the radius, as well as the lower surface of the flange portion 123 is held by the second inner housing portion 102 locked in place by elastic arm portion 118 in a direction perpendicular to the direction supra. Thereby, the power supply terminal 121 is positioned vertically.

In an embodiment, when the power supply terminal 121 is inserted into the terminal penetrating portion 114 from the lower direction, the circumferential surface having the conic shape of the flange portion 123 thereof abuts against at least one of the edges of the first inner housing portion 101. Then the second inner housing portion 102 is inserted until it abuts with the underside of the flange portion 123, and locks in place through the engagement of the elastic arm portions 118 with the underside of the engaging portions 103. Thereby, the flange portion 123 is held as the upper and lower surfaces thereof are sandwiched.

Figure 3A:
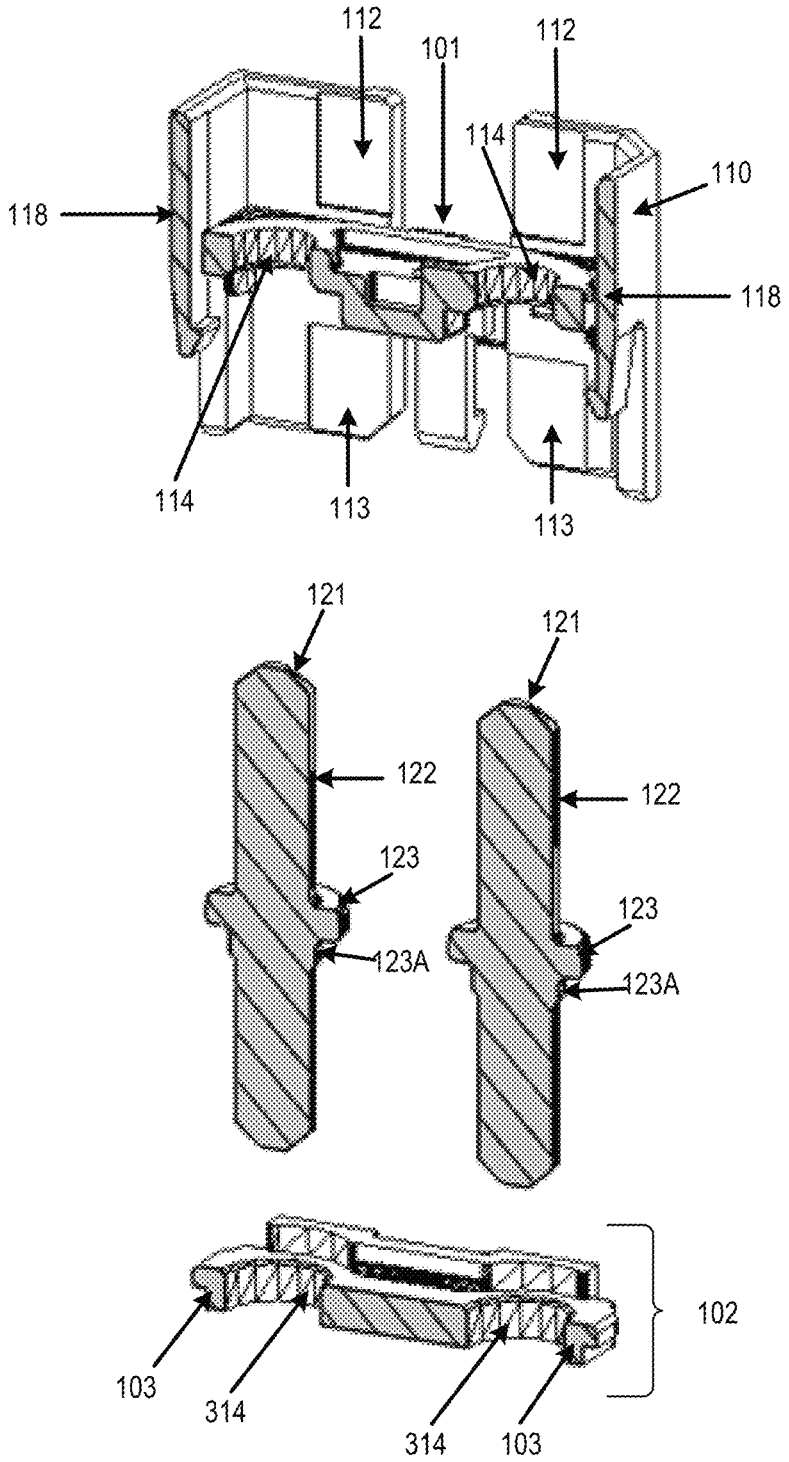
FIGS. 3(*a*) and 3(*b*) illustrate the intermediate connector in a disassembled state, in accordance with an embodiment.
Figure 3B:
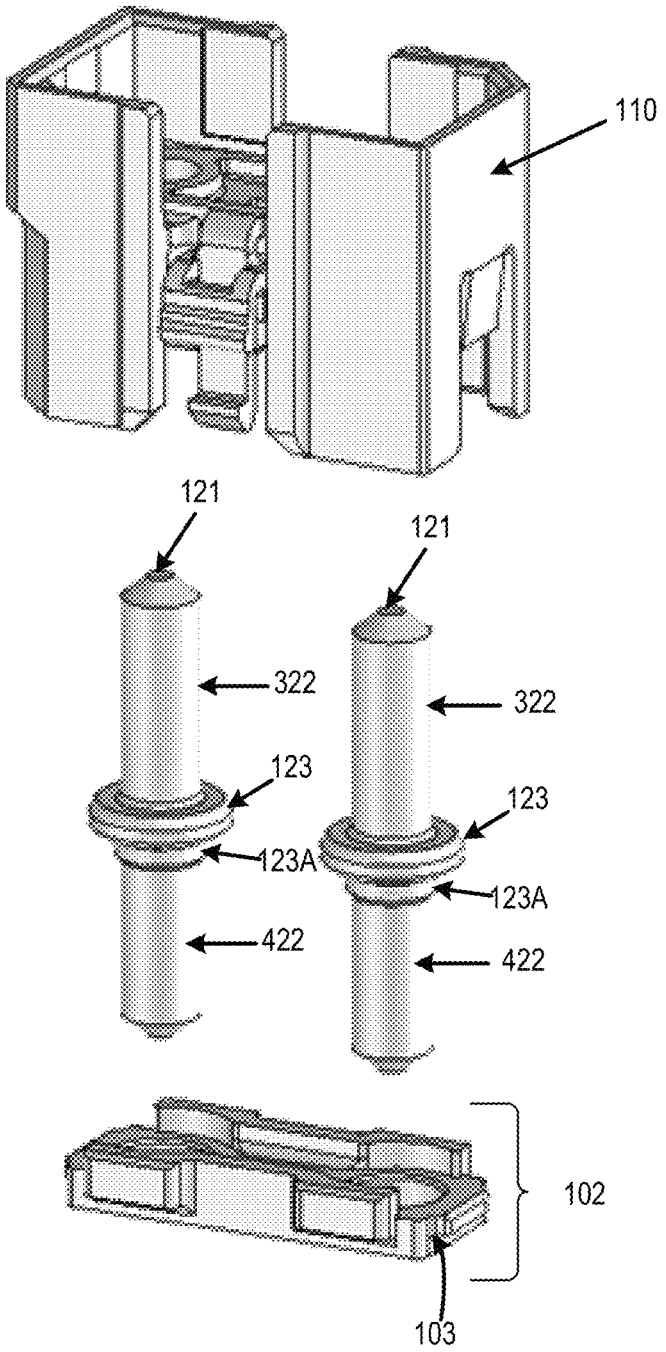

FIG. 3(*a*) illustrates a cross-sectional view of the intermediate connector in a disassembled state, in accordance with an embodiment. In the example of FIG. 3(*a*), the cross-sectional view is taken in parallel to the direction in which the power supply terminals are inserted into the electrical connector assembly.

As illustrated in the cross section of FIG. 3(*a*), the intermediate connector may have one or more first terminal penetrating portions 114 in the first inner housing portion 101 configured to engage with the main body portion of a power supply terminal from the plurality of power supply terminals. A space is formed between an inner surface of the terminal penetrating portion 114 and the power supply terminal 121. The first inner housing portion 101 is aligned with the second inner housing portion 102 through the alignment of the first terminal penetrating portions 114 and the second terminal penetrating portions 314. Flange portion 123 of the power supply terminal 121 is configured to be disposed between the first inner housing portion 101 and the second inner housing portion 102 and can be arranged to contact with an edge of at least one of the of the first terminal penetrating portions 114 and second terminal penetrating portions 314. As illustrated in FIG. 3(*a*), the flange portion 123 has a width greater than the width of the first terminal penetrating portion 114 and the width of the second terminal penetrating portion 314. As illustrated in FIG. 3(*a*), latching portions 118 are disposed on opposite sides of the first inner housing portion 101 in the form of elastic arms configured to engage the engaging portion 103 of the second inner housing portion 102, which is detachable from the outer housing 111. In this manner, the latching portions 118 can engage the second inner housing portion 101 without coming into contact with the power supply terminal 121.

As illustrated in FIG. 3(*a*) the width of the first terminal penetrating portion 114 can be different from the width of the second terminal penetrating portion 314. Both widths can be smaller than the width of the flange portion 123 so that the flange portion 123 is disposed between the first inner housing portion 101 and the second inner housing portion 102. In the example of FIG. 3(*a*), the width of the second terminal penetrating portions 314 is larger than the width of the first terminal penetrating portions 114 so as to accommodate the circumferential surface 123A of the flange portion 123. In this manner, the orientation of the power supply terminal 121 is set so that the circumferential surface 123A is disposed within the second terminal penetrating portion 314.

FIG. 3(*b*) illustrates the intermediate connector in a disassembled state, in accordance with an embodiment. As illustrated in FIG. 3(*b*), the flange portion 123 of the power supply terminals 121 are disposed such that the main body portion 122 is divided into a first body portion 322 that is configured to be engaged with the plurality of first terminal penetrating portions 114 and a second body portion 422 that is configured to be engaged with the plurality of second terminal penetrating portions 314. Flange portion 123 including the circumferential surface 123A of the flange portion 123 serve to divide the main body portion 122 such that the first body portion 322 is longer than the second body portion 422. Through this embodiment, the desired orientation of the power supply terminal 121 is set so that the power supply terminal 121 is not installed in the wrong direction.

As illustrated in FIGS. 3(*a*) and 3(*b*) the main body portion 122 of the power supply terminal 121 is cylindrical, and can be accommodated with a space within the first terminal penetrating portion 114 and the second terminal penetrating portion 314 so that the main body portion 121 can move within the plurality of first terminal penetrating portion 114 and the plurality of second terminal penetrating portion 314. Through such an implementation, the tolerances and flexibility of the electrical connector assembly can be maintained.

Figure 4A:
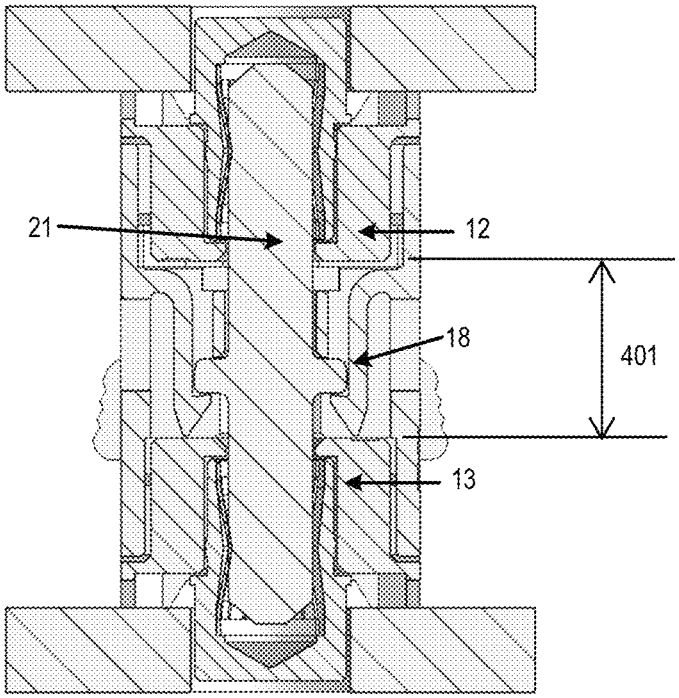
FIG. 4(a) (Related Art)
FIGS. 4(*a*) and 4(*b*) illustrates the difference in locking length between the related art implementation and an embodiment of the present disclosure.
Figure 4B:
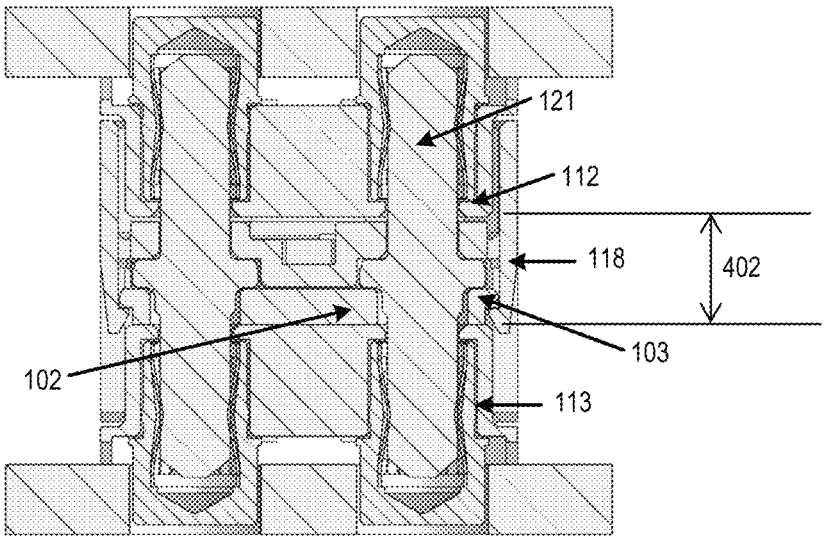

FIGS. 4(*a*) and 4(*b*) illustrates the difference in locking length between the related art implementation and an embodiments of the present disclosure. In the related art implementation as illustrated in FIG. 4(*a*), the locking length between the first receptacle 12 and the second receptacle 13 is indicated in 401. Because the elastic arm 18 of FIG. 4(*a*) extends from the sidewall to engage directly with the power supply terminal 21, the locking length 401 is larger than the locking length 402 as illustrated in FIG. 4(*b*). As shown in FIG. 4(*b*), because the latching portions 118 are configured to engage with the engagement portion 103 of the second inner housing portion 102 without contacting the power supply terminal 121, the locking length can be reduced between the first receptacle 112 and second receptacle 113. In implementations of an embodiment, the reduction in length can be a millimeter or more.

In the present invention, in the embodiments described above, the connector includes only the power supply terminal. The connector may include a signal terminal as well as the power supply terminal. Further, other connector including the signal terminal may be used in combination.

Furthermore, the elastic tubular member is not limited to be configured as shown in the drawings. The elastic tubular member may be any conductive members having a substantial cylindrical shape capable of elastic displacement by the same amount at any angle within a circumferential direction.

While the invention has been explained with reference to the specific embodiments of the invention, the explanation is illustrative and the invention is limited only by the appended claims.

What is claimed is:

1. An electric connector assembly, comprising:

a first mating connector to be attached to a first circuit board;

a second mating connector to be attached to a second circuit board; and an intermediate connector disposed between the first mating connector and the second mating connector for connecting the first mating connector to the second mating connector, the intermediate connector comprising:

a plurality of power supply terminals, each of the plurality of power supply terminals comprising a main body portion and a flange portion having a larger width than the main body portion;

an outer housing comprising:

a first inner housing portion affixed to the outer housing, the first inner housing portion comprising a plurality of first terminal penetrating portions, each of the plurality of the first terminal penetrating portions configured to engage with the main body portion of the power supply terminal from the plurality of power supply terminals; and latching portions; and a second inner housing portion configured to align with the first inner housing portion, the second inner housing portion comprising:

engaging portions configured to engage the second inner housing portion to the outer housing via the latching portions; and a plurality of second terminal penetrating portions, each of the plurality of the second terminal penetrating portions configured to engage with the main body portion of the power supply terminal from the plurality of power supply terminals;

wherein the flange portion of the power supply terminal from the plurality of power supply terminals is disposed between the first inner housing portion and the second inner housing portion and is arranged to contact with an edge of at least one of the plurality of the first terminal penetrating portions and the plurality of the second terminal penetrating portions, wherein the flange portion has a width greater than a first width of the plurality of the first terminal penetrating portions and greater than a second width of the plurality of the second terminal penetrating portions.

2. The electric connector assembly according to claim 1, wherein the main body portion of the plurality of power supply terminals are cylindrical, wherein the main body portion is accommodated with a space within the plurality of the first terminal penetrating portions and the plurality of the second terminal penetrating portions so that the main body portion can move within the plurality of the first terminal penetrating portions and the plurality of the second terminal penetrating portions, wherein the flange portion is arranged to contact with the edge of at least one of the plurality of the first terminal penetrating portions and the plurality of the second terminal penetrating portions.

3. The electric connector assembly according to claim 1, wherein the latching portions are elastic arms disposed on opposite sides of the outer housing portion and configured to be in contact with the second inner housing portion without coming in contact with the plurality of the power supply terminals.

4. The electric connector assembly according to claim 1, wherein the flange portion of the plurality of the power supply terminals are disposed such that the main body portion is divided into a first body portion and a second body portion, the first body portion being longer than the second body portion; wherein the first body portion is configured to be engaged with the plurality of the first terminal penetrating portions, and wherein the second body portion is configured to be engaged with the plurality of the second terminal penetrating portions.

5. The electric connector assembly according to claim 1, wherein the latching portions are elastic arms disposed on opposite sides of the outer housing and configured to be in contact with the second inner housing portion without coming in contact with the power supply terminal.

6. The electric connector assembly according to claim 1, wherein the flange portion of the power supply terminal is disposed such that the main body portion is divided into a first body portion and a second body portion, the first body portion being longer than the second body portion; wherein the first body portion is configured to be engaged with the first terminal penetrating portion, and wherein the second body portion is configured to be engaged with the second terminal penetrating portion.

7. An electric connector assembly, comprising:

a first mating connector to be attached to a first circuit board;

a second mating connector to be attached to a second circuit board; and an intermediate connector disposed between the first mating connector and the second mating connector for connecting the first mating connector to the second mating connector, the intermediate connector comprising:

a power supply terminal comprising a main body portion and a flange portion having a larger width than the main body portion;

an outer housing comprising:

a first inner housing portion affixed to the outer housing, the first inner housing portion comprising a first terminal penetrating portion configured to engage with the main body portion of the power supply terminal; and latching portions;

and a second inner housing portion configured to align with the first inner housing portion, the second inner housing portion comprising:

engaging portions configured to engage the second inner housing portion to the outer housing via the latching portions; and a second terminal penetrating portion configured to engage with the main body portion of the power supply terminal;

wherein the flange portion of the power supply terminal is disposed between the first inner housing portion and the second housing portion and is arranged to make contact with an edge of at least one of the first terminal penetrating portion and the second terminal penetrating portion, wherein the flange portion has a width greater than a first width of the first terminal penetrating portion and greater than a second width of the second terminal penetrating portion.

8. The electric connector assembly according to claim 7, wherein the main body portion of the power supply terminal is cylindrical, wherein the main body portion is accommodated with a space within the first terminal penetrating portion and the second terminal penetrating portion so that the main body portion can move within the first terminal penetrating portion and the second terminal penetrating portion, wherein the flange portion is arranged to contact with the edge of at least one of the first terminal penetrating portion and the second terminal penetrating portion.

* * * * *